US006953369B2

(12) United States Patent
Sasaki et al.

(10) Patent No.: US 6,953,369 B2
(45) Date of Patent: Oct. 11, 2005

(54) CARD CONNECTOR CAPABLE OF INHIBITING INSERTION OF A THINNER CARD WITH A SIMPLE STRUCTURE

(75) Inventors: Masamichi Sasaki, Tokyo (JP); Keisuke Nakamura, Tokyo (JP); Takamitsu Wada, Saitama (JP); Keiichiro Suzuki, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/870,081

(22) Filed: Jun. 17, 2004

(65) Prior Publication Data

US 2005/0003712 A1 Jan. 6, 2005

(30) Foreign Application Priority Data

Jun. 18, 2003 (JP) ..... 2003-172794

(51) Int. Cl.[7] ..... H01R 13/64
(52) U.S. Cl. ..... 439/680
(58) Field of Search ..... 439/630, 674, 439/677, 680, 681; 361/736, 737, 756–759, 752

(56) References Cited

U.S. PATENT DOCUMENTS

| | | | | | |
|---|---|---|---|---|---|
| 3,799,724 | A | * | 3/1974 | Grady | 425/311 |
| 6,644,550 | B1 | * | 11/2003 | Pickles | 235/486 |
| 6,669,512 | B2 | * | 12/2003 | Lee | 439/630 |
| 6,764,323 | B2 | * | 7/2004 | Shimada et al. | 439/138 |

FOREIGN PATENT DOCUMENTS

| | | |
|---|---|---|
| JP | 9016833 | 1/1997 |
| JP | 9035021 | 2/1997 |

* cited by examiner

*Primary Examiner*—Renee Luebke
*Assistant Examiner*—James R. Harvey
(74) *Attorney, Agent, or Firm*—Collard & Roe, P.C.

(57) ABSTRACT

In a card connector for use in connection of a card, a guide portion connected to a connector body. The guide portion is adapted to guide movement of the card with respect to the connector body. A selecting portion is connected to the guide portion and has an engaging portion. When the card has a predetermined thickness, the selecting portion is elastically deformed by contact with the card to allow further movement of the card. When the card is thinner than the predetermined thickness, the engaging portion is engaged with the card to inhibit further movement of the card.

8 Claims, 4 Drawing Sheets

CARD CONNECTOR CAPABLE OF INHIBITING INSERTION OF A THINNER CARD WITH A SIMPLE STRUCTURE

This application claims priority to prior Japanese patent application JP 2003-172794, the disclosure of which is incorporated herein by reference.

BACKGROUND OF THE INVENTION

This invention relates to a card connector and, in particular, to a card connector having a mechanism for inhibiting insertion of a card thinner than a predetermined thickness.

A typical card connector comprises a connector body for connecting a card, and a guide portion for guiding movement of the card with respect to the connector body. The guide portion is designed in conformity with a card having a predetermined thickness. Therefore, it is generally impossible to insert a card thicker than the predetermined thickness into the guide portion.

However, a card thinner than the predetermined thickness can be inserted into the guide portion. If such a thinner card is inserted through the guide portion into the connector body, it is assumed that a contact in the connector body may be accidentally deformed or broken.

Japanese Patent Application Publication (JP-A) No. H9-16833 or H9-35021 discloses a card processing apparatus having a mechanism for inhibiting insertion of a card thinner than a predetermined thickness. However, since a mechanism for rotating a shutter is required, it is inevitable that the apparatus is complicated in structure and increased in scale.

SUMMARY OF THE INVENTION

It is therefore an object of the present invention to provide a card connector capable of inhibiting insertion of a thinner card with a simple structure.

Other objects of the present invention will become clear as the description proceeds.

According to an aspect of the present invention, there is provided a card connector comprising a connector body to be connected with a card, a guide portion connected to the connector body and adapted to guide movement of the card with respect to the connector body, and a selecting portion connected to the guide portion and, when the card has a predetermined thickness, elastically deformed by contact with the card to allow further movement of the card, the selecting portion having an engaging portion to be engaged with the card to inhibit further movement of the card when the card is thinner than the predetermined thickness.

According to an aspect of the present invention, there is provided a card connector comprising a connector body for connecting a card, a pair of guide portions connected to the connector body and adapted to guide opposite end portions of the card with respect to the connector body, and a pair of selecting portions connected to the guide portions, respectively, and elastically deformed by contact with the card to alloy further movement of the card when the card has a predetermined thickness, the selecting portion having an engaging portion to be engaged with the card to inhibit further movement of the card when the card is thinner than the predetermined thickness.

DESCRIPTION OF THE PREFERRED EMBODIMENTS

Figure 1:
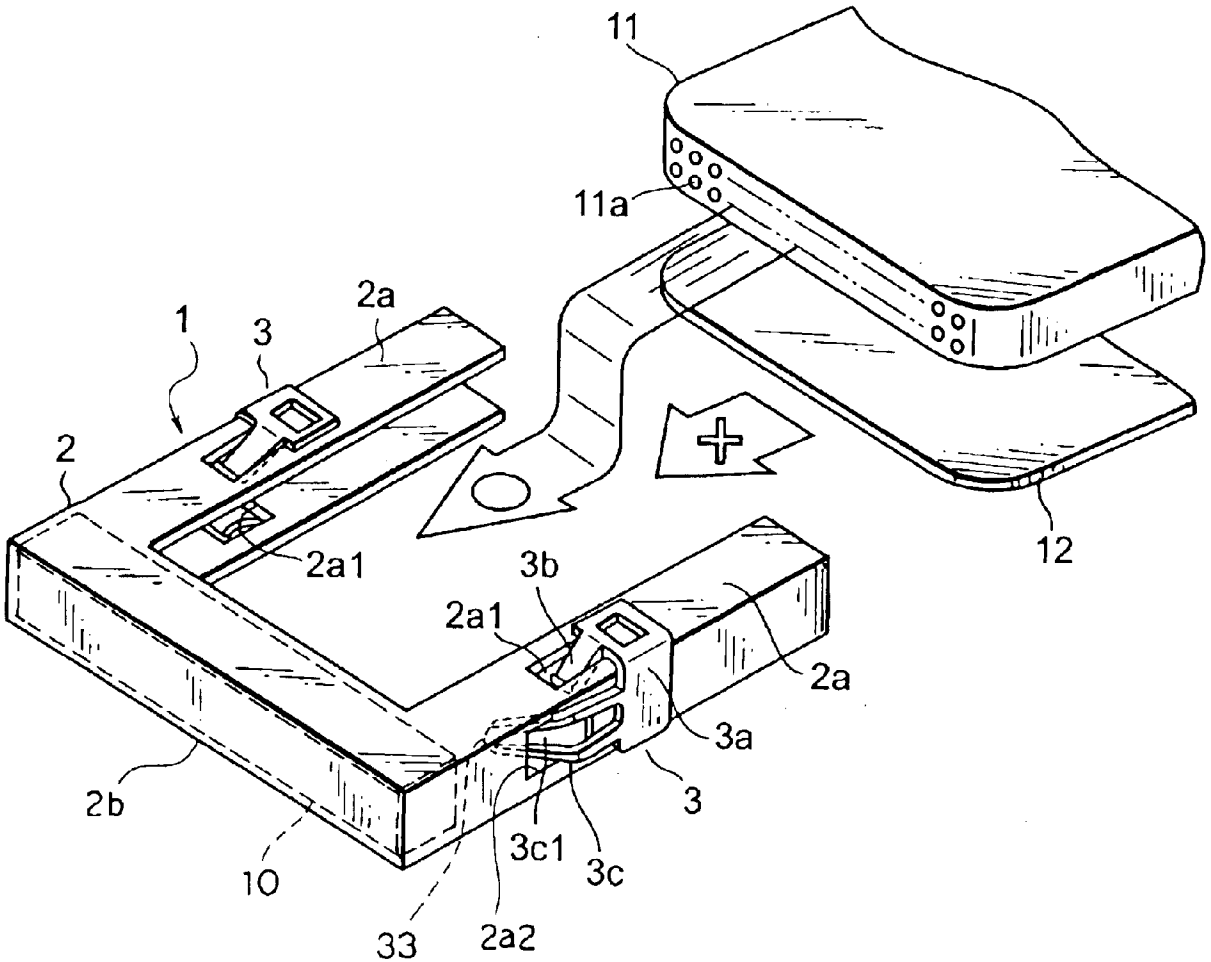
FIG. 1 is a perspective view showing a card connector according to a first embodiment of the present invention together with a card having a predetermined thickness and another card thinner than the predetermined thickness in a state before each card is inserted.

Referring to FIG. 1, a card connector according to a first embodiment of the present invention will be described.

The card connector 1 illustrated in FIG. 1 comprises a frame 2. The frame 2 has a pair of left and right guide portions 2*a* and a connecting portion 2*b* connecting the guide portions 2*a* to each other. The frame 2 is integrally formed into a U shape as a whole. Inside the connecting portion 2*b*, a connector body 10 as a fitting portion is fixed. The connector body 10 has a plurality of conductive pin contacts (not shown) to be electrically connected to a card 11 having a predetermined thickness. Each of the guide portions 2*a* is provided with an allowance/inhibition selecting member 3 for inhibiting insertion of a card 12 thinner than the predetermined thickness into the card connector 1.

Figure 2:
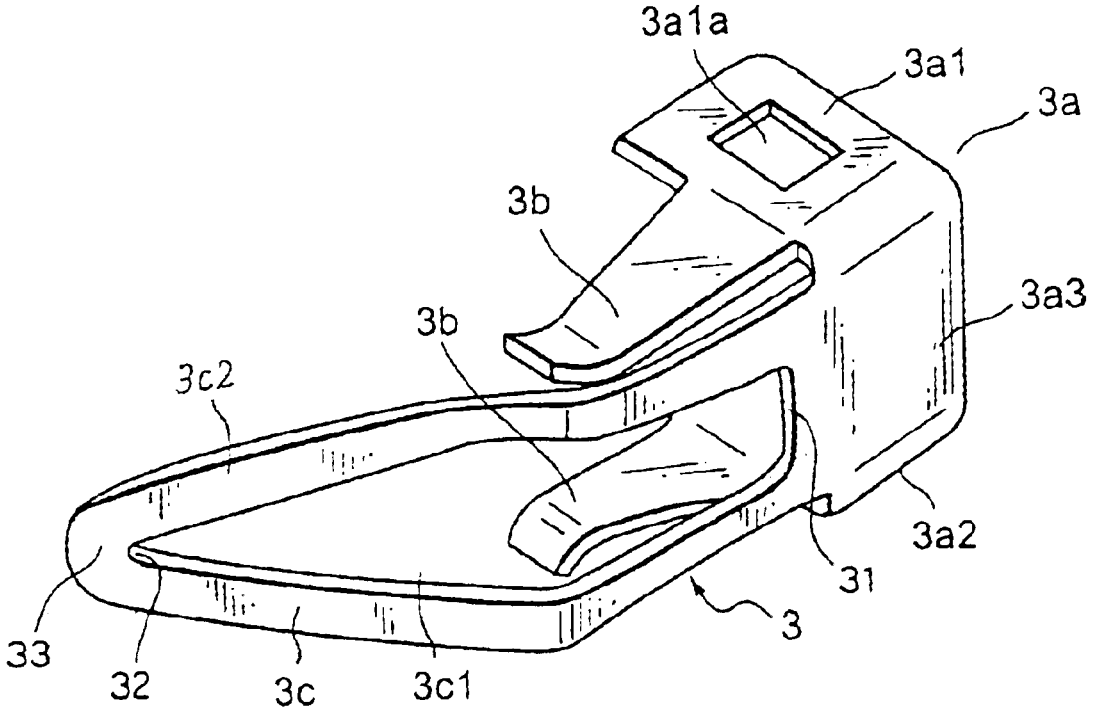
FIG. 2 is an enlarged perspective view of an allowance/inhibition selecting member used in the card connector illustrated in FIG. 1.

Referring to FIG. 2, description will be made of each allowance/inhibition selecting member 3.

Each allowance/inhibition selecting member 3 is integrally formed to have a U-shaped base portion 3*a*, a pair of inward slanting portions 3*b* elastically deformable and extending from upper and lower parts 3*a*1 and 3*a*2 of the base portion 3*a*, and a selecting portion 3*c* elastically deformable and extending from a side part 3*a*3 of the base portion 3*a*. The selecting portion 3*c* has a first end 32 connected to the side part 3*a*3 of he base portion 3*a* and a second end 31 as a free end. The selecting portion 3*c* has an opening 3*c*1 formed at its center and defined by an annular rim or an annular defining edge 3*c*2.

The upper part 3*a*1 is provided with a hole 3*a*1*a* in order to attach the allowance/inhibition selecting member 3 to the guide portion 2*a*. Similarly, the lower part 3*a*2 is provided with a hole although not shown in the figure. Therefore, each guide portion 2*a* has particular portions which correspond or face the holes of the upper and the lower parts 3*a*1 and 3*a*2.

Turning back to FIG. 1, each guide portion 2*a* is provided with holes 2*a*1 formed on upper and lower surfaces thereof to receive the inward slanting portions 3*b*, respectively. Further, each guide portion 2*a* is provided with a hole 2*a*2 formed on its side surface to receive the selecting portion 3*c*. Each allowance/inhibition selecting member 3 is fixed to each guide portion 2*a* by staking or caulking the above-mentioned particular portions of each guide portion 2*a* towards the holes 3*a*1, respectively. The inward slanting portions 3*b* and the selecting portion 3*c* are received in the holes 2*a*1 and the hole 2*a*2, respectively.

Figure 3A:
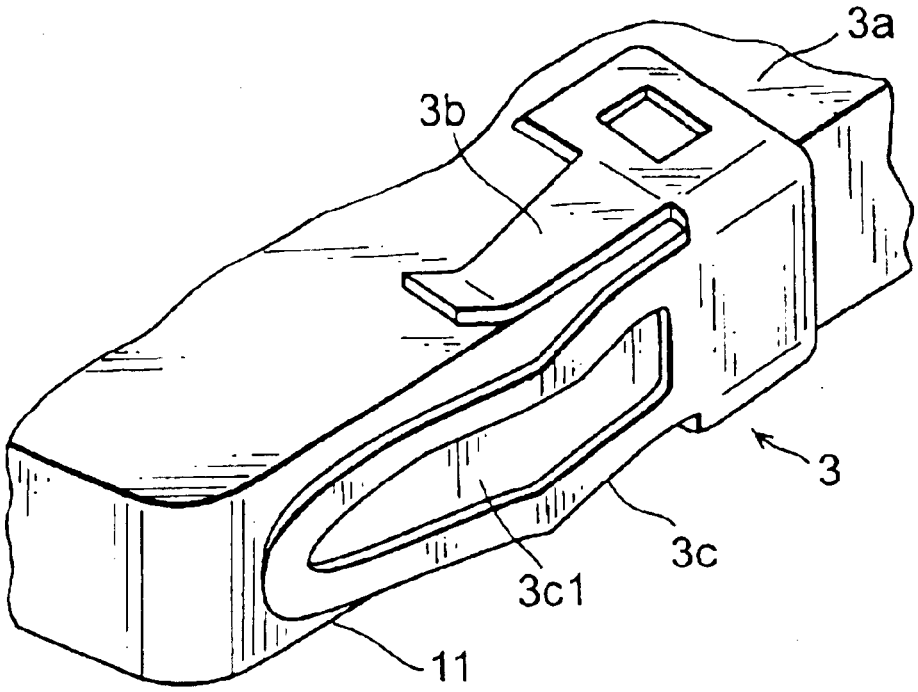
FIG. 3A is an enlarged perspective view of a characteristic part of the card connector in FIG. 1 when the card having the predetermined thickness is inserted.

When the card 11 having the predetermined thickness is inserted into the left and the right guide portions 2*a* of the card connector 1 in a direction depicted by an arrow, opposite principal surfaces of the card 11 having the predetermined thickness elastically deform the inward slanting portions 3*b* in a vertical direction to separate the inward slanting portions 3*b*, 3*b* from each other, as illustrated in FIG. 3A. Further, opposite side surfaces, i.e., opposite edge portions of the card 11 having the predetermined thickness elastically deform the selecting portions 3*c* outward from the guide portions 2*a*. When the card 11 having the predetermined thickness is further inserted, a plurality of socket contacts 11*a* formed at a front end portion of the card 11 having the predetermined thickness are connected to the pin contacts of the connector body 10 of the card connector 1.

Figure 3B:
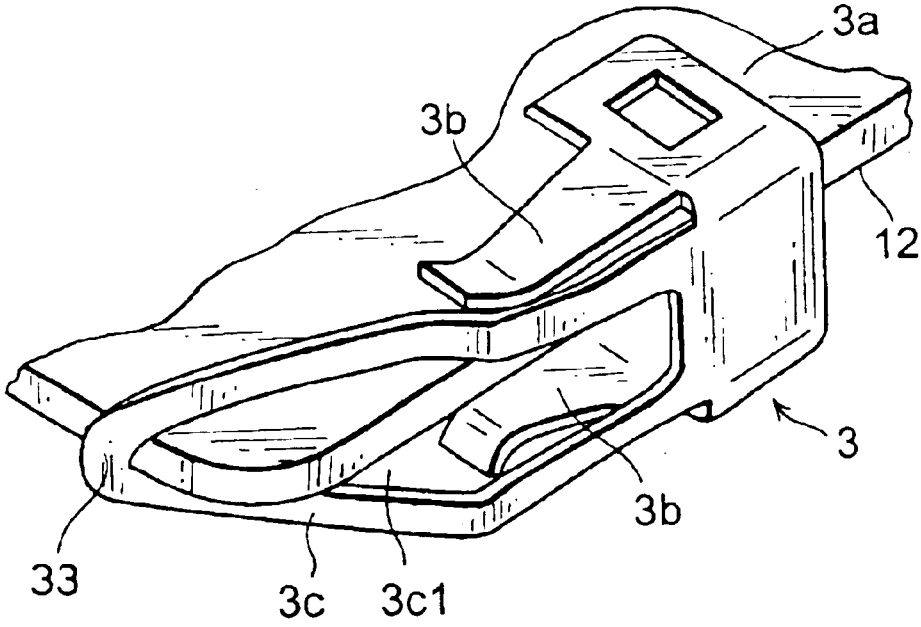
FIG. 3B is a view similar to FIG. 3A but when the card thinner than the predetermined thickness is inserted.

On the other hand, when the card 12 thinner than the predetermined thickness is inserted into the guide portions 2*a* in a direction depicted by an arrow, the thinner card 12 is clamped by the inward slanting portions 3*b* and urged towards a center thereof in the card thickness direction. As a result, the thinner card 12 is guided into the opening 3*c*1 of the selecting portion 3*c*, as illustrated in FIG. 3B. Thus, a combination of the inward slanting portions 3*b* serves as a position restricting member for restricting a position of the card 12 in a card thickness direction to align said card with said engaging portion. When the thinner card 12 is further inserted, a front end face of the thinner card 12 is butted against an engaging portion 33 at one end of each opening 3*c*1. Therefore, the thinner card 12 is inhibited from being further inserted.

Next referring to FIG. 4, a card connector according to a second embodiment will be described. Similar parts are designated by like reference numerals and description thereof will be omitted.

Figure 4:
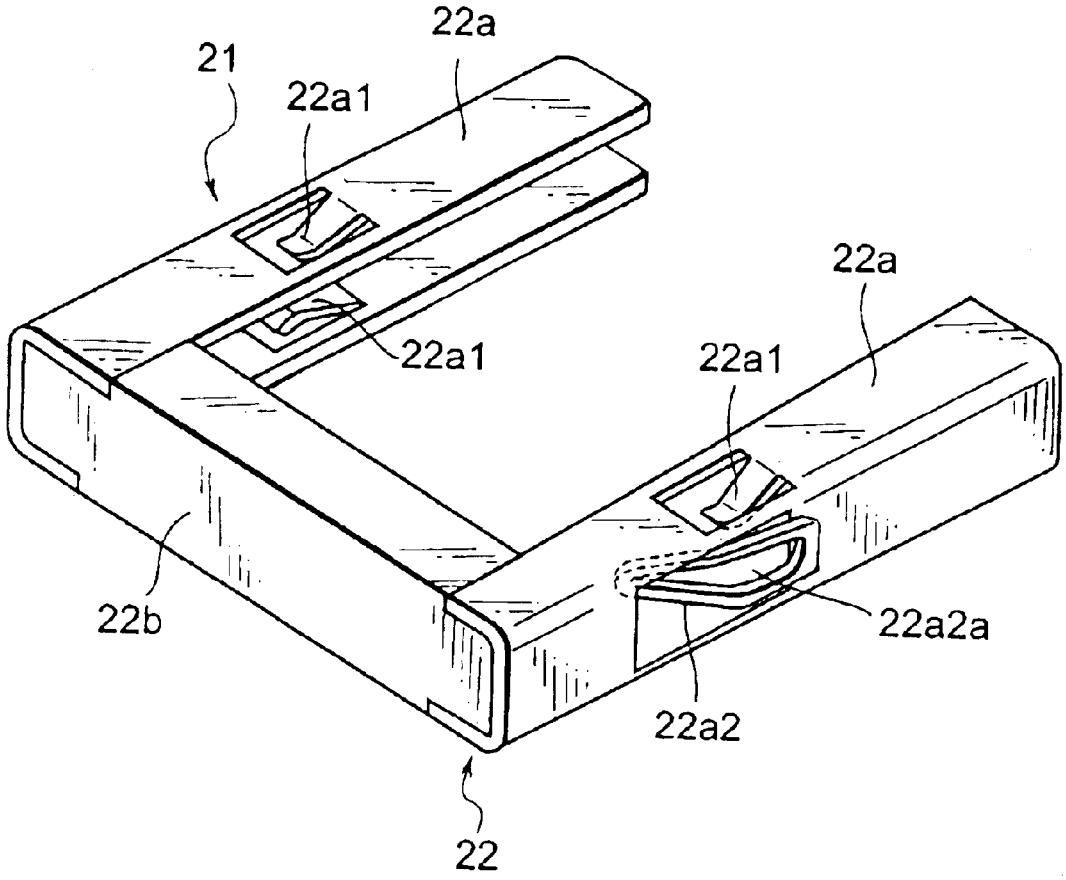
FIG. 4 is a perspective view of a card connector according to a second embodiment of this invention.

The card connector 21 illustrated in FIG. 4 has guide portions 22*a* and a connecting portion 22*b* connecting the guide portions 22*a* to each other. Each of guide portions 22*a* has inward slanting portions 22*a*1 and a selecting portion 22*a*2 integrally formed. In order to simplify a production process, the guide portions 22*a* and the connecting portion 22*b* are produced as individual separate components and thereafter connected into a single frame 22.

In the card connector 1 or 21, two pairs of the inward slanting portions 3*b* or 22*a*1 are formed. However, either one pair of the inward slanting portions may be omitted.

Further, each allowance/inhibition selecting member 3 of the card connector 1 may lack the inward slanting portion 3*b*. Likewise, each guide portion 22*a* of the card connector 21 may lack the inward slanting portion 22*a*1. Even in this case, a desired effect is achieved if the card connector 1 or 21 has a structure such that the side surfaces of the card 11 having the predetermined thickness forces the selecting portions 3*c* or 22*a*2 out of a card insertion path while the thinner card 12 is guided into the openings 3*c*1 or 22*a*2*a* of the selecting portions 3*c* or 22*a*2 and the front end face of the thinner card 12 is butted against one ends of the openings 3*c*1 or 22*a*2*a*. As an example of the above-mentioned structure, the selecting portions 3*c* or 22*a*2 are arranged adjacent to an inside bottom surface of the guide portions 2*a* or 22*a*.

While this invention has thus far been described in conjunction with the preferred embodiments thereof, it will be readily possible for those skilled in the art to put this invention into practice in various other manners without departing from the scope set forth in the appended claims.

What is claimed is:

1. A card connector comprising:

a connector body to be connected with a card;

a guide portion connected to said connector body and adapted to guide movement of said card with respect to said connector body;

a selecting portion extending from a vertical surface of said guide portion and, when said card has a predetermined thickness, elastically deformed by contact with said card to allow further movement of said card, said selecting portion having an engaging portion to be engaged with said card to inhibit further movement of said card when said card is thinner than said predetermined thickness; and a position restricting member elastically deformable and extending from a horizontal surface of said guide portion, said position restricting member being for restricting a position of said card in a card thickness direction to align said card with said engaging portion.

2. The card connector according to claim 1, wherein said position restricting member has a pair of inward slanting portions elastically deformable and connected to said guide portion, said inward slanting portion being faced to each other in the thickness direction of said card.

3. The card connector according to claim 1, wherein said position restricting member and said selecting member are formed integral with each other into an allowance/inhibition selecting member.

4. The card connector according to claim 3, wherein said allowance/inhibition selecting member is formed as a separate component separate from said guide portion and attached to said guide portion.

5. The card connector according to claim 1, wherein at least one of said position restricting member and said selecting member is integrally formed with said guide portion.

6. The card connector according to claim 1, wherein said selecting portion has a first end connected to said guide portion and a second end as a free end positioned in a path of said card, said engaging portion being formed at said second end.

7. The card connector according to claim 6, wherein said selecting portion has a defining edge defining an opening extending from said first end to said second end, said defining edge having a part corresponding to said second end and serving as said engaging portion.

8. A card connector comprising:

a connector body for connecting a card;

a pair of guide portions extending from a vertical surface of said connector body and adapted to guide opposite end portions of said card with respect to said connector body;

a pair of selecting portions connected to said guide portions, respectively, and elastically deformed by contact with said card to alloy further movement of said card when said card has a predetermined thickness, said selecting portion having an engaging portion to be engaged with said card to inhibit further movement of said card when said card is thinner than said predetermined thickness; and a pair of position restricting members elastically deformable and extending from a horizontal surface of said guide portions, respectively, each of said position restricting members being for restricting a position of said card in a thickness direction to align said card with said engaging portion.

* * * * *